US007921528B2

(12) United States Patent
Elhaj

(10) Patent No.: US 7,921,528 B2
(45) Date of Patent: Apr. 12, 2011

(54) BROKEN HEART SHAPED COFFIN

(76) Inventor: Antoine Elhaj, Sandusky, OH (US)

( * ) Notice: Subject to any disclaimer, the term of this patent is extended or adjusted under 35 U.S.C. 154(b) by 183 days.

(21) Appl. No.: 12/430,882

(22) Filed: Apr. 27, 2009

(65) Prior Publication Data

US 2010/0269317 A1 Oct. 28, 2010

(51) Int. Cl.
*A61G 17/00* (2006.01)

(52) U.S. Cl. ..... 27/12; 27/2

(58) Field of Classification Search ..... 27/2, 14, 27/16, 17, 27, 12; 16/424, 439
See application file for complete search history.

(56) References Cited

U.S. PATENT DOCUMENTS

| | | | | | |
|---|---|---|---|---|---|
| 1,851,225 | A * | 3/1932 | Wesemann | 16/439 |
| 2,735,157 | A * | 2/1956 | Hotchkiss et al. | 27/12 |
| 3,348,280 | A * | 10/1967 | Myers | 27/2 |
| 3,844,003 | A * | 10/1974 | Angermann | 27/35 |
| 4,868,957 | A * | 9/1989 | Rojdev | 27/17 |
| 4,993,129 | A * | 2/1991 | Underwood et al. | 27/12 |
| 5,231,741 | A * | 8/1993 | Maguire | 27/12 |
| D543,005 | S * | 5/2007 | Pertz | D99/5 |
| D611,675 | S * | 3/2010 | Elhaj | D99/5 |
| 7,703,186 | B1 * | 4/2010 | Williamson | 27/2 |
| 2010/0212125 | A1 * | 8/2010 | Elhaj | 27/27 |
| 2010/0212355 | A1 * | 8/2010 | Elhaj | 63/1.14 |
| 2010/0293768 | A1 * | 11/2010 | Elhaj | 27/35 |

* cited by examiner

*Primary Examiner* — William L. Miller
(74) *Attorney, Agent, or Firm* — Ronald J. Koch

(57) ABSTRACT

A coffin having a curved bottom surface and a removable cover that accommodates bodies of differing lengths having, within an enclosure, a support platform that adjusts to different angles so as to accommodate bodies of different sizes.

2 Claims, 5 Drawing Sheets

BROKEN HEART SHAPED COFFIN

The present application is related to the co-pending patent application Ser. No. 12/390,400 of Antoine Elhaj, filed Feb. 20, 2009, entitled "Broken Heart Shaped Coffin", and based on which priority is herewith claimed under 35 U.S.C. 120 and the disclosure of which is incorporated herein by reference in its entirety as if fully rewritten herein.

BACKGROUND AND SUMMARY

The present invention relates generally to coffins and specifically to coffins having unique shapes and systems and methods for housing bodies in coffins. The terms casket and coffin as used herein are interchangeable.

One embodiment of a coffin that accommodates bodies of differing lengths comprises, within an enclosure, a support platform that adjusts so as to accommodate bodies of varying lengths. Traditional caskets have a flat bottom and the body can not be manipulated by bending at the hip. Additionally, traditional caskets are lacking in visual appeal.

DETAILED DESCRIPTION

Figure 1:
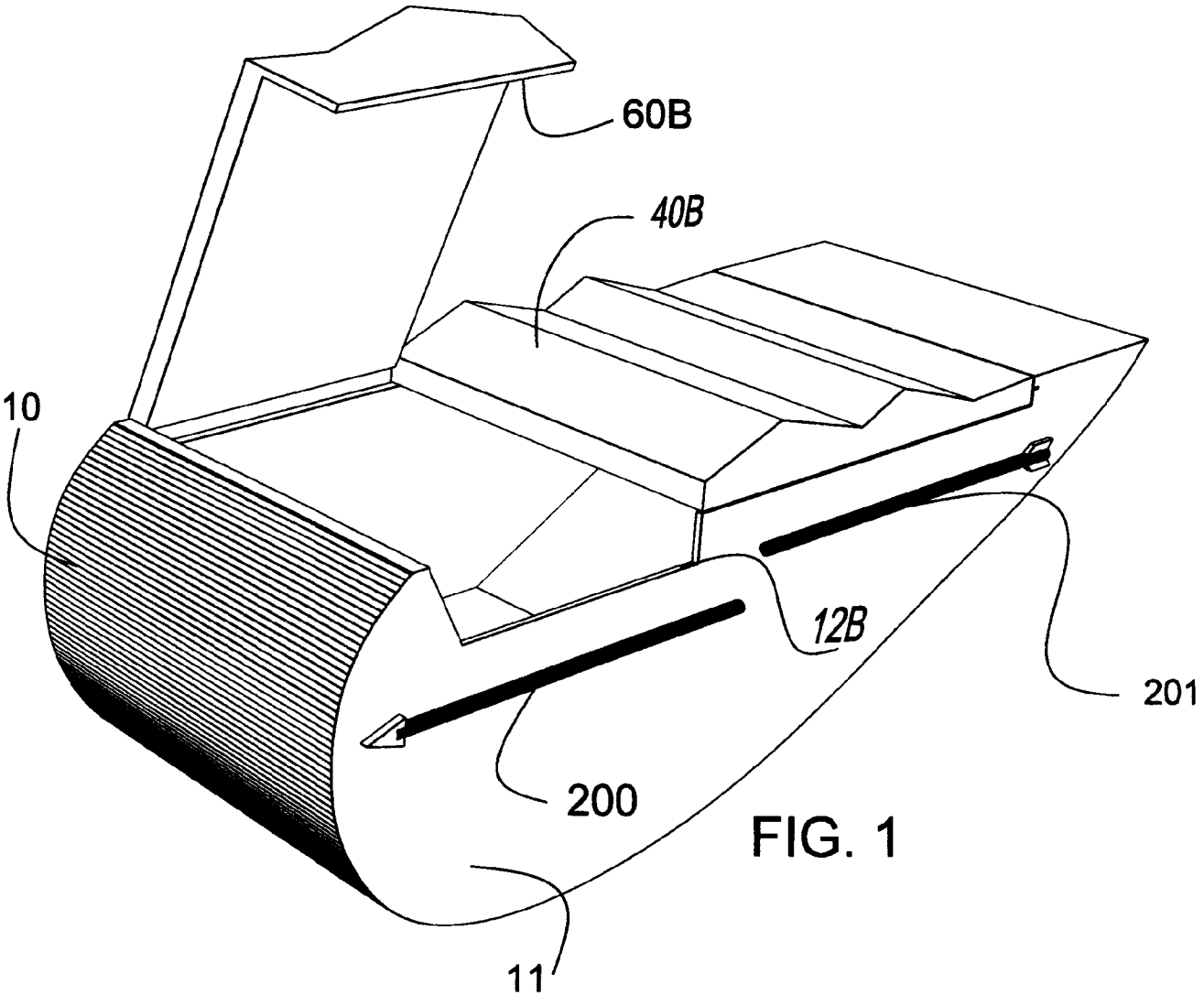
FIG. 1 depicts a perspective view of the invention

One embodiment of a coffin that accommodates bodies of differing lengths comprises, within an enclosure, a platform 231 that adjusts so as to bend the body at the hip whereby the longitudinal length of the body can be adjusted.

In one embodiment, the coffin comprises, a curved bottom surface 10; two vertical side walls 11 attached to each side of the curved bottom surface so as to form a container having an opening 12; a removable cover 40B & 60B being attachable to the opening whereby the container can be sealed; and a support platform 231 having a first end 235 in communication with vertical elevating means whereby the platform can be variably adjusted so as to support human bodies of different sizes.

In one embodiment, the vertical elevating means comprises: a threaded nut 234 being pivotably connected to the first end 235 of the support platform 231; a support member 230 being secured within the container and having an aperture; an acme rod 232 fitting within the aperture and having an upper flange 233 of greater diameter than the aperture; the acme rod being threadedly engaged to the threaded nut; whereby the acme rod can be rotated to change the vertical position of the first end of the support platform.

In one embodiment, the rod 232 has an outer diameter of one half inch, ten threads per inch. One of skill in the art will appreciate that other types of threaded rods can be used. In operation, the rod is rotated to cause the platform to change elevation to accommodate bodies of different lengths.

Support member 230 is affixed to the interior (lateral center) of the coffin proximate the location of the head of the deceased. The rod 232 (fitting within an aperture in support member 230) is positioned essentially in the lateral middle of the casket, so the nut 234 is positioned accordingly to align with it.

The threaded nut 234 is pivotably connected to the first end 235 of the support platform 231 essentially at the lateral center thereof. The pivotal connection allows the nut to pivot as it traverses rod 232. The nut fits within an aperture.

In one embodiment, the aperture in support member 230 is made somewhat larger than the rod 232 to allow some play. This allows the rod to pivot somewhat as the support member is adjusted.

Figure 2A:
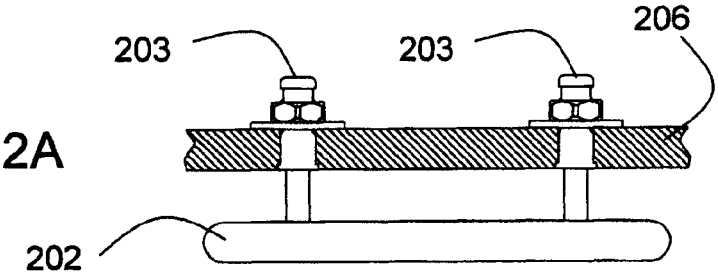
FIG. 2A depicts a sectional plan view of the carrying handles of the invention in the extended position
Figure 2B:
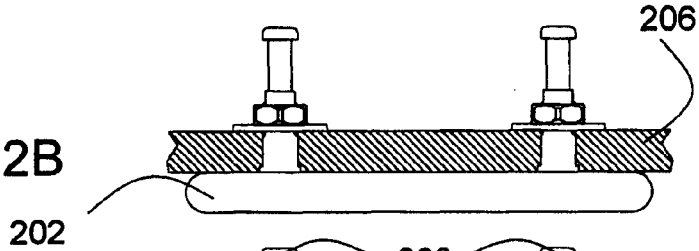
FIG. 2B depicts a sectional plan view of the carrying handles of the invention in the retracted position

In one embodiment, the coffin comprises carrying handles 200, 201 affixed to each of the vertical side walls. The handles being adjustable between retracted (FIG. 2B) and extended (FIG. 2A) positions.

Figure 2C:
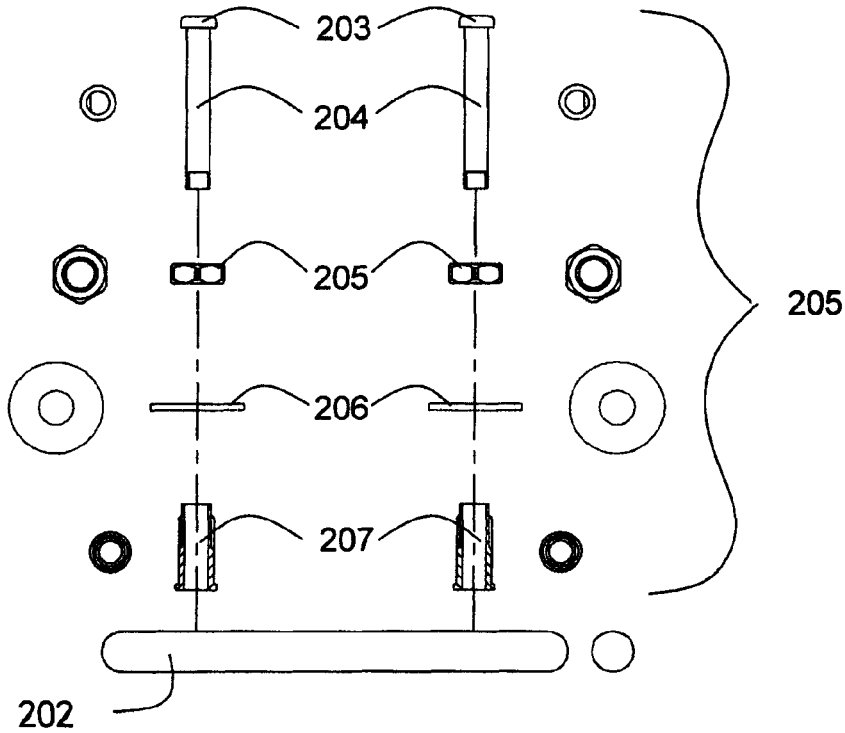
FIG. 2C depicts an exploded view of the carrying handle mounting assembly of the invention
Figure 3A:
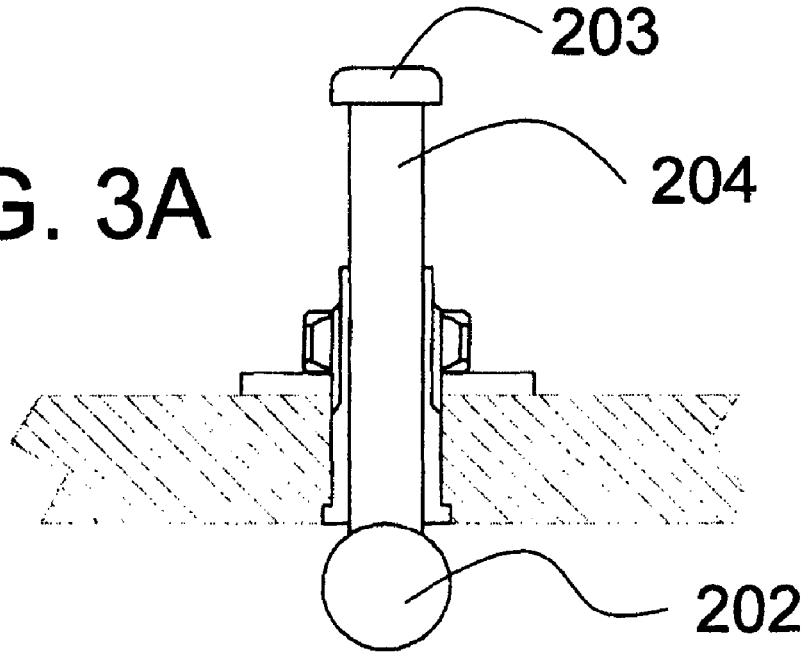
FIG. 3A depicts a sectional frontal view of the carrying handles of the invention in the retracted position
Figure 3B:
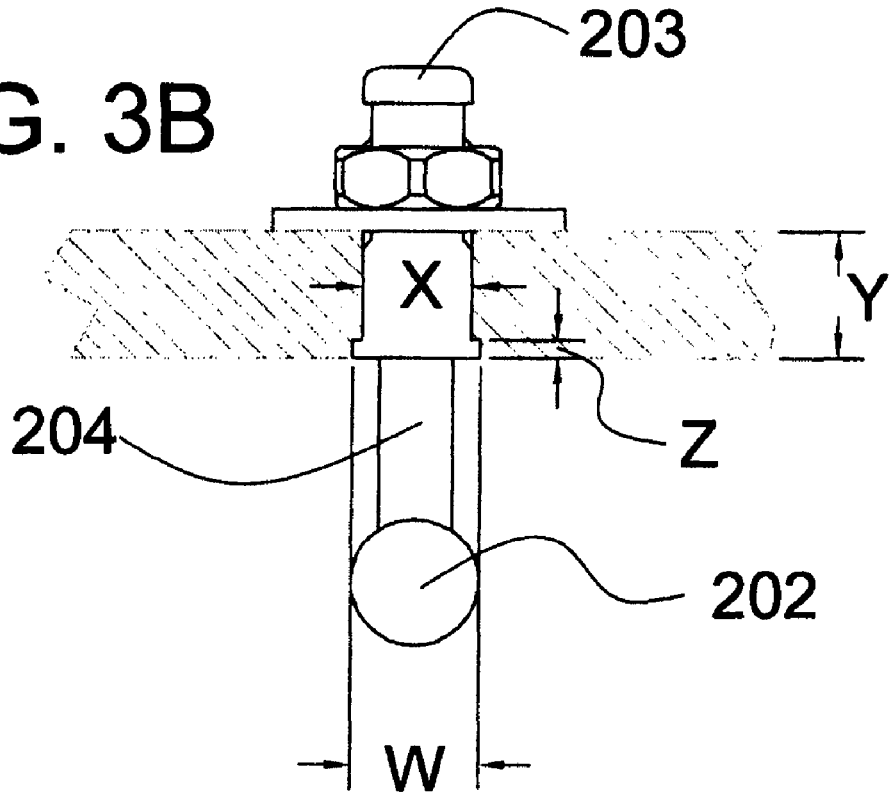
FIG. 3B depicts a sectional frontal view of the carrying handles of the invention in the extended position
Figure 4:
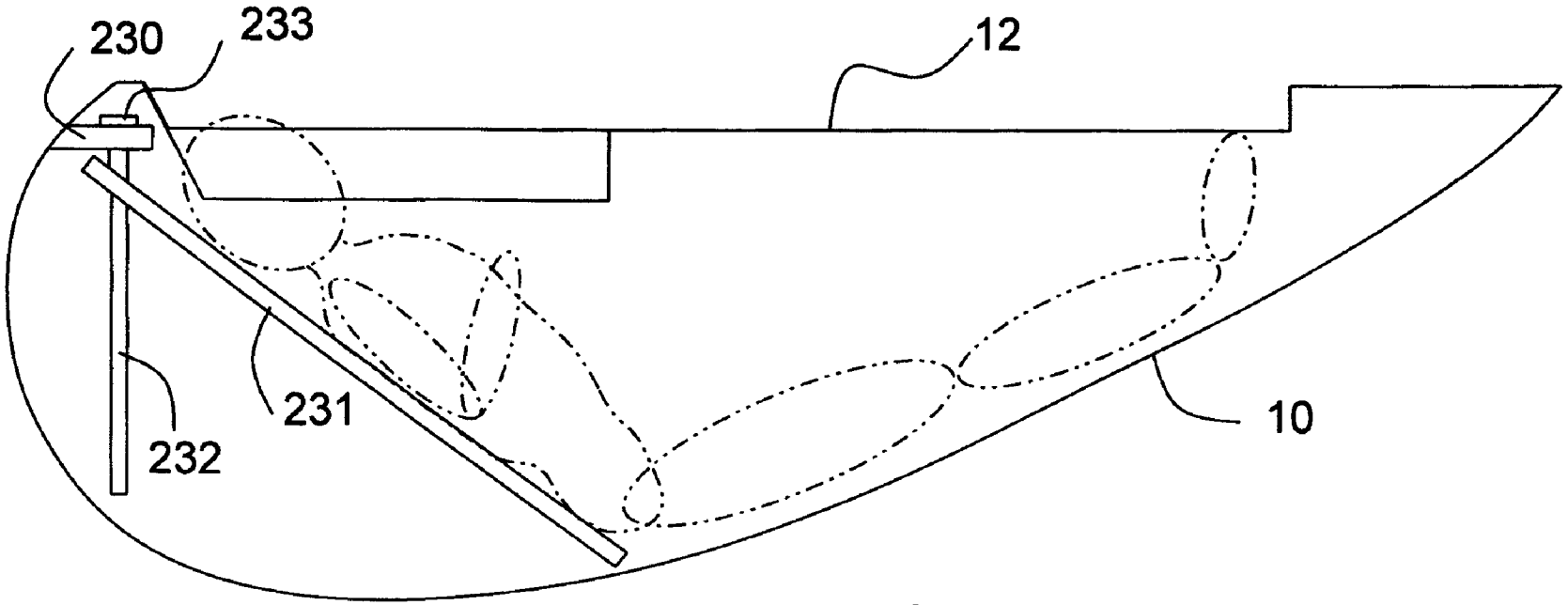
FIG. 4 depicts a side cross sectional view of the invention
Figure 5C:
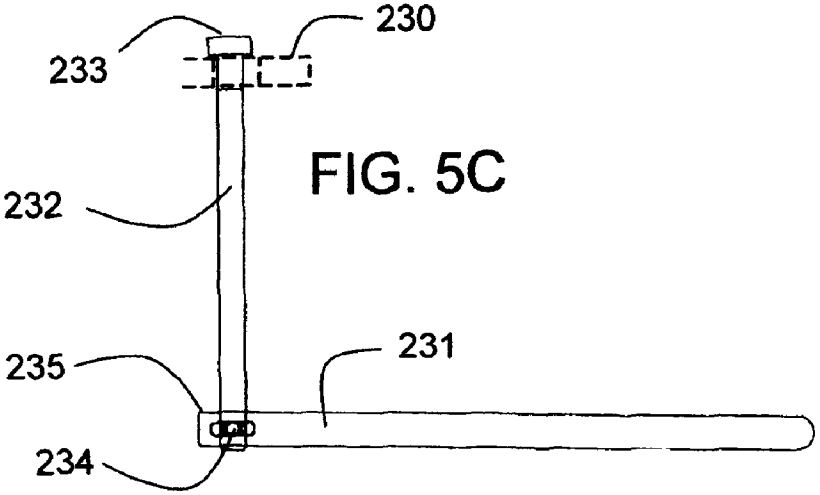
FIGS. 5A, 5B, 5C, & 5D depict a side view of the support platform and elevating means assembly in various adjusted positions
Figure 5D:
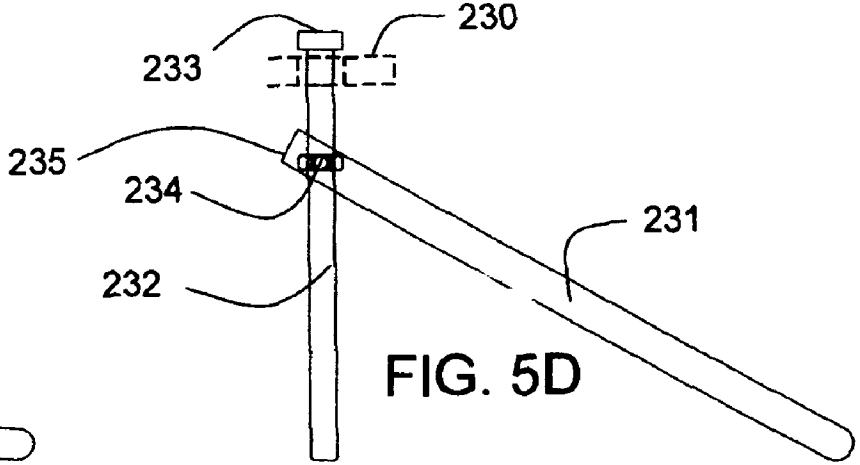
Figure 5A:
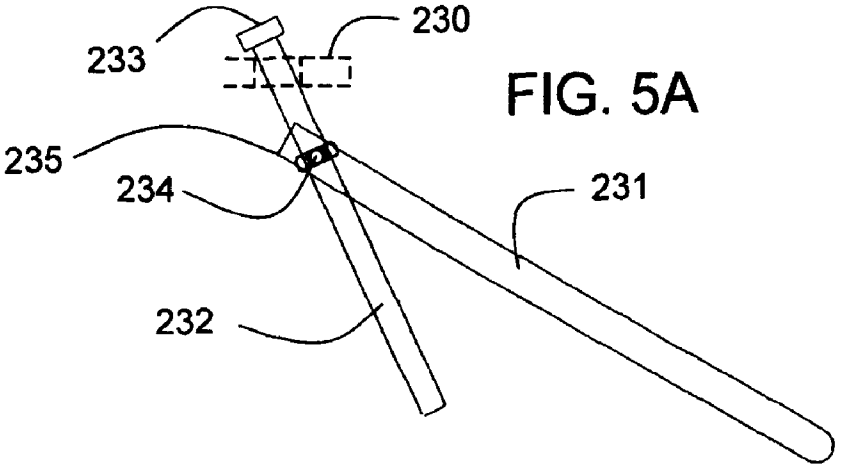
Figure 5B:
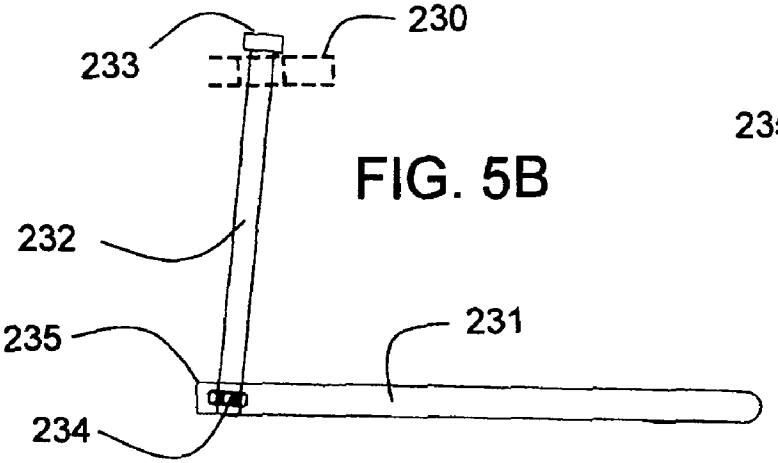

As depicted in FIG. 2C, the dual position handles are achieved by a pair of posts 204, each having a shoulder 203, the fits within a sleeve 207, that in turn fits within an aperture in side wall 206 (analogous to vertical side walls 11) and being secured by washer 206 and nut 205. As depicted, the handles are referenced by character 202, but the relationship is analogous to handles 200 and 201 in other depictions. FIG. 2C depicts a pair of posts and associated accessories in side and plan view. Plan view is adjacent to the outside.

In one embodiment (FIG. 1), the carrying handles comprise a pair of carrying handles 200, 201 affixed to one vertical side wall 11 of the container, the pair having the appearance of a broken arrow as viewed from the side and being adjustable between retracted and extended positions. In the various embodiments depicted, the carrying handles can alternatively be fixed to only an extended position.

The function of the removable cover can be achieved by either separate cover pieces or one unitary cover. It is preferred that gaskets be utilized to facilitate sealing the casket. However, they are not essential. In one embodiment (FIG. 1), the removable cover comprises first and second cover portions 60B & 40B. Although not essential, it is preferred that a gasket be used at the junction of the two cover portions.

What is claimed is:

1. A coffin comprising:

a curved bottom surface for a support surface;

two planar vertical side walls attached to each side of said curved bottom surface so as to form a container having an opening;

a removable cover being attachable to said opening whereby said container is sealed;

a support platform having a first end in communication with vertical elevating means whereby said platform is variably adjusted so as to support human bodies of different sizes;

wherein said vertical elevating means comprises, a threaded nut pivotably connected to said first end of said support platform;

a support member being secured within said container and having an aperture;

an acme rod fitting within said aperture and having an upper flange of greater diameter than said aperture;

said acme rod being threadedly engaged to said threaded nut;

whereby said acme rod is rotated to change the vertical position of said first end of said support platform.

2. A coffin comprising:

a curved bottom surface for a support surface;

two planar vertical side walls attached to each side of said curved bottom surface so as to form a container having an opening;

a removable cover being attachable to said opening whereby said container is sealed;

a support platform having a first end in communication with vertical elevating means whereby said platform is variably adjusted so as to support human bodies of different sizes;

wherein said vertical elevating means comprises, a threaded nut pivotably connected to said first end of said support platform;

a support member being secured within said container and having an aperture;

a threaded rod fitting within said aperture and having an upper flange of greater diameter than said aperture, the threaded portion of said rod having an outer diameter of one half inch and further having ten threads per inch;

said threaded rod being threadedly engaged to said threaded nut;

whereby said threaded rod is rotated to change the vertical position of said first end of said support platform.

* * * * *